United States Patent [19]

Steinike

[11] Patent Number: 4,891,860

[45] Date of Patent: Jan. 9, 1990

[54] DEVICE FOR DISTRIBUTING THE AIR BLAST IN A CLEANING DEVICE FOR TEXTILE MACHINES

[75] Inventor: Ulrich Steinike, Augsburg, Fed. Rep. of Germany

[73] Assignee: Ernst Jacobi & Co. KG., Augsburg, Fed. Rep. of Germany

[21] Appl. No.: 268,490

[22] Filed: Nov. 8, 1988

[30] Foreign Application Priority Data

Nov. 13, 1987 [DE] Fed. Rep. of Germany ..... 3738582

[51] Int. Cl.[4] ..... A47L 5/14

[52] U.S. Cl. ..... 15/312 A; 15/316 R; 15/416

[58] Field of Search ..... 15/312 R, 312 A, 316 R, 15/416

[56] References Cited

U.S. PATENT DOCUMENTS 1,234,446 7/1917 Clark ..... 15/416 X 3,375,539 4/1968 Loepinger ..... 15/312 R 3,486,184 12/1969 King ..... 15/312 R

*Primary Examiner*—Chris K. Moore

[57] ABSTRACT

A device for distributing air blast in a cleaning device for textile machines. Blow hoses, adapted to the respective type of machine, are used for cleaning spinning and winding machines arranged in a row. An air distributor box having a valve is provided between the ventilator and the blow hose. The valve interrupts the supply of air blast to a blow hose and directs the air blast into another blow hose during the transition from one type of machine to the other. Flow losses result due to the air distributor box and the valve. In the present device, a housing surrounds the spiral ventilator housing and has an air duct for each blow hose. The ventilator housing is provided with a blast opening and can be turned about the impeller axis. The ventilator housing is brought into a rotating position in which its blast opening discharges into the air duct, to whose blow hose the air blast is to be conducted.

9 Claims, 4 Drawing Sheets

DEVICE FOR DISTRIBUTING THE AIR BLAST IN A CLEANING DEVICE FOR TEXTILE MACHINES

The invention relates to a device for distributing the air blast in a cleaning device for textile machines.

Nowadays, it is customary to arrange various types of textile machines in a row, for example, spinning and winding machines. Air must be blown against these different machines at various points in order to remove loose fuzz.

In order to be able to blow on the different machines at different points, German Pat. No. DE-OS 34 25 545 teaches that two hoses are to be led out from the distributor box of the cleaning device, the hoses having different openings directed onto the machines. These two hoses are disposed at two horizontally extending connecting pieces on the distributor box and are led vertically downward after having been bent 90°. A flat air-conducting part is disposed in the air distributor box, the air-conducting part revolving about a horizontal axis and sealing either the one or the other connecting orifice. In accordance with a further embodiment of that invention, it is taught that two hoses are to be provided which can be adjusted within one other, whereby the inner hose is displaced with respect to the outer hose when there is a transition from one type of machine to another.

According to German Pat. No. DE-GM 85 08 228, valves having horizontal swivel axes are provided in the air distributor box, these valves conducting the air blast onto one of three blow hoses attached to the distributor box. One blow hose is for blowing on a winding machine, the second hose is for blowing on a spinning machine and the third hose is for blowing on the whorl valves of spinning machines.

In the device according to German Patent Application No. P 36 18 934.0, a flat, horizontally extending distributor box is provided to which the vertically extending blow hoses are attached. A flat slide valve is disposed in the distributor box and this slide valve keeps the openings of the blow hoses, except for one opening, sealed.

A disadvantage of these known devices is that air deflections occur in the distributor boxes and the distribution of air blast takes place by means of valves or slides, whereby the efficiency of the cleaning device is diminished. Moreover, the overall efficiency varies depending on the distribution of the air blast on the individual blow hoses.

It is the object of the invention to design the air blast distributor device in such a way that the efficiency of the cleaning device is not influenced by it. Furthermore, the structural size of the cleaning device should not be influenced by the air blast distributor device.

According to an embodiment of the invention, a device is provided for distributing the air blast in a cleaning device for textile machines having blow hoses fulfilling at least two different cleaning tasks, alternately into which the blast air of a ventilator is conducted, the ventilator having an impeller and a spiral ventilator housing surrounding the impeller, at least one tuyere opening which is connected to at least one air duct of the device housing, the device housing having an air duct for each blow hose, the ventilator housing being pivoted about the impeller axis by the device housing with its tuyere opening in one of the air ducts opening between the air ducts.

An embodiment of the invention is illustrated in greater detail below with reference to the drawings, showing:

Figure 1A:
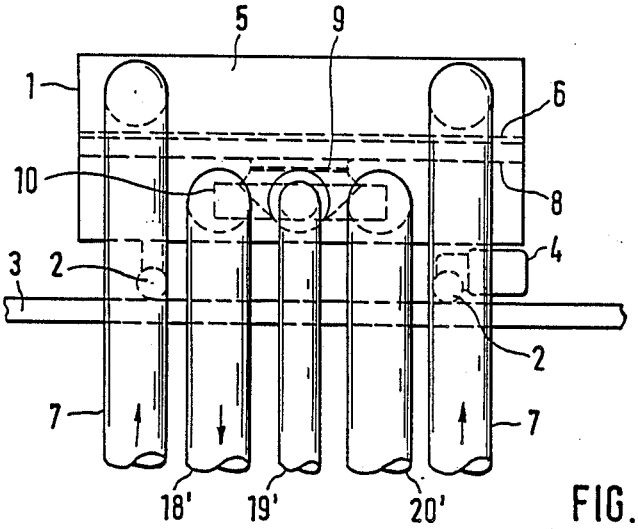
FIG. 1 is a side view and a top view in a first operating position of the device.

The cleaning device has a device housing 1 which can be moved back and forth via rollers 2 on rails 3 above the textile machines to be cleaned. This is driven by an electric motor 4. A collecting chamber 5, which is sealed at the bottom by a sieve 6, is provided in the upper part of the device housing 1. Four suction hoses 7 are attached to this collecting chamber 5. A horizontally extending partition 8, which has a central air intake opening 9, is disposed below the screen 6. The impeller 10 of the ventilator of the cleaning device is below this central air intake device. This impeller 10 is surrounded by the ventilator housing 11. This ventilator housing has a double spiral 13, 13', which extends point-symmetrically to the axis 12 of the ventilator and has two tuyeres of blast openings 14, 14'.

Three first air ducts 15, 16, 17 and three second air ducts 15', 16', 17', which extend point-symmetrically to the axis 12 thereof, are disposed below the partition 8 in the device housing 1. First blow hoses 18, 19, 20 are attached to the air ducts 15, 16, 17 and second blow hoses 18', 19', 20' are attached to the air ducts 15', 16', 17'. Inside the device housing, the air ducts 15 to 17' have openings 21, 22, 23 and 21', 22', 23', which are disposed on a circular cylindrical wall 24 of the device housing 1. These openings 21 to 23' are at the same level and have the same diameter as the blast or tuyere openings 14, 14' of the ventilator housing 11.

Figure 1B:
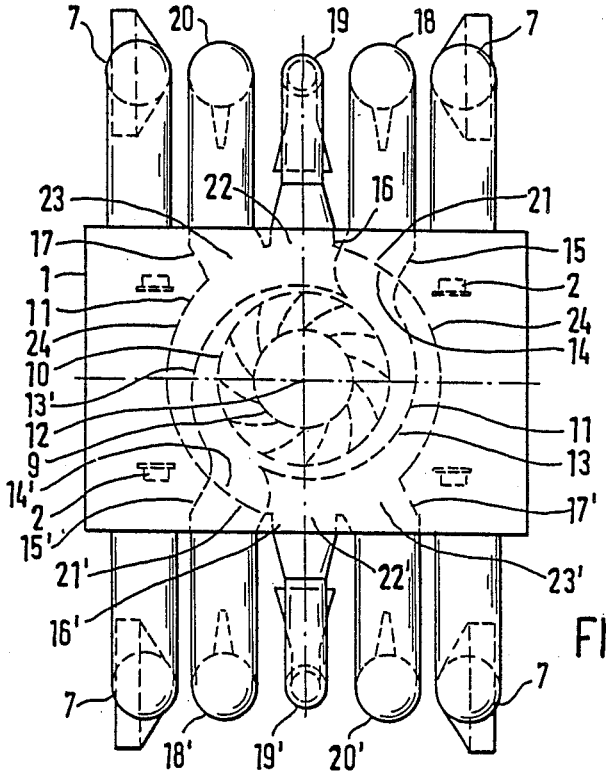
Figure 2A:
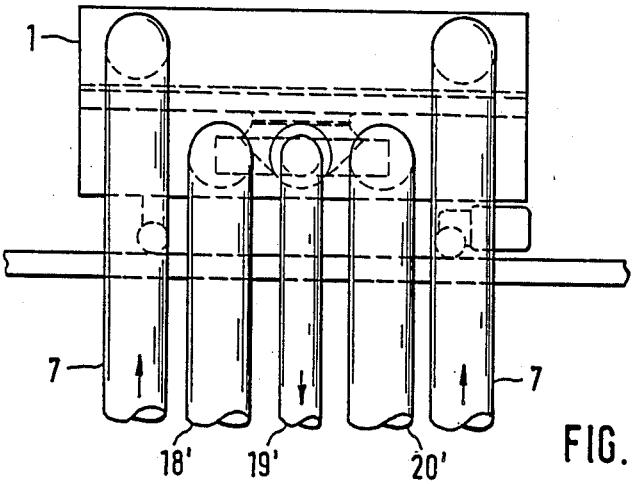
FIG. 2 are views corresponding to FIG. 1 in a second operating position.
Figure 2B:
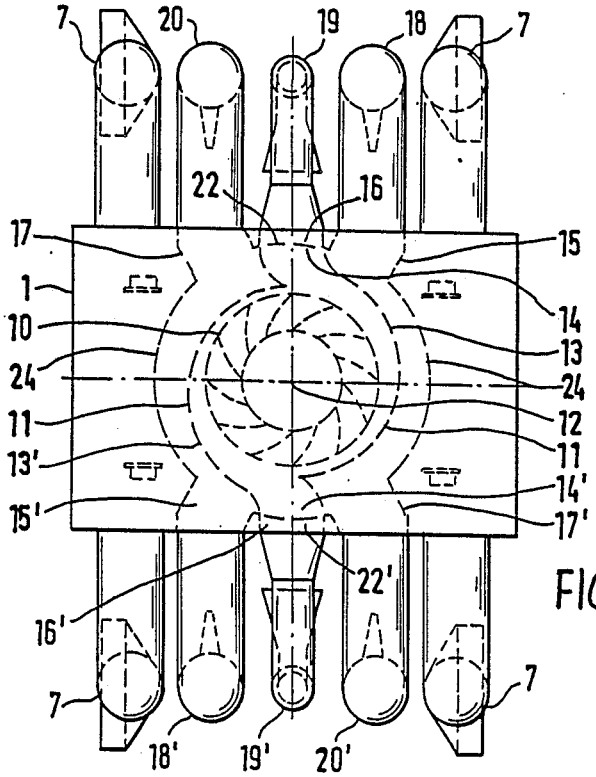

The ventilator housing 11 is pivoted about the ventilator axis 12 in the device housing 1. In a first rotating position of the ventilator housing 11, its blast or tuyere openings 14, 14' align with the openings 21, 21' of the air ducts 15, 15', as a result of which the entire air blast is conducted into the blow hoses 18, 18'. This is shown in FIG. 1. If the ventilator housing is turned counterclockwise into the position shown in FIG. 2, then the blast openings 14, 14' of the ventilator housing align with the openings 22, 22' of the air ducts 16, 16', so that all the air blast is now conducted into blow hoses 19, 19'.

Figure 3A:
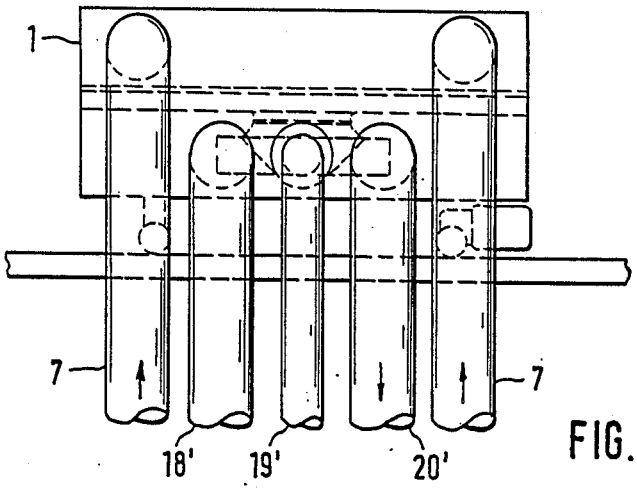
FIG. 3 are corresponding views in a third operating position.
Figure 3B:
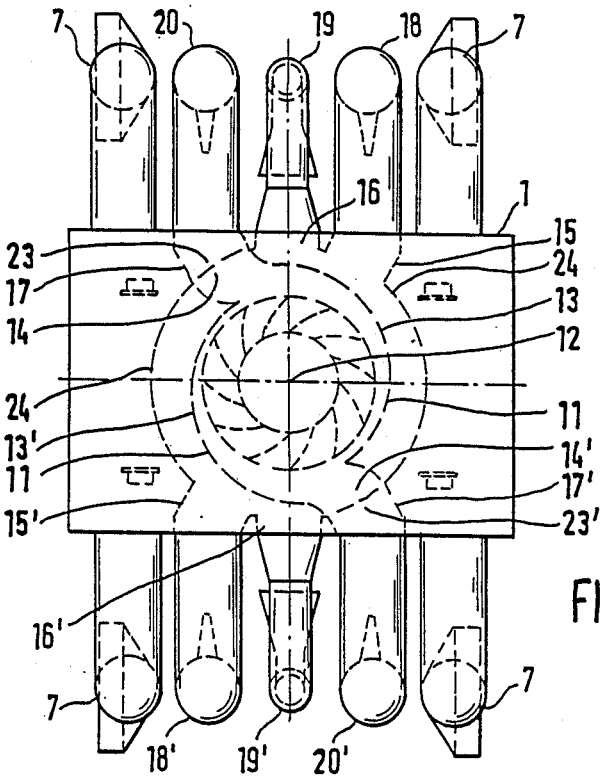

If the ventilator housing 11 is turned into the position shown in FIG. 3, then its blast openings 14, 14' align with the openings 23, 23' of the air ducts 17, 17', so that all the air blast is now conducted into the blow hoses 20, 20'.

Figure 4A:
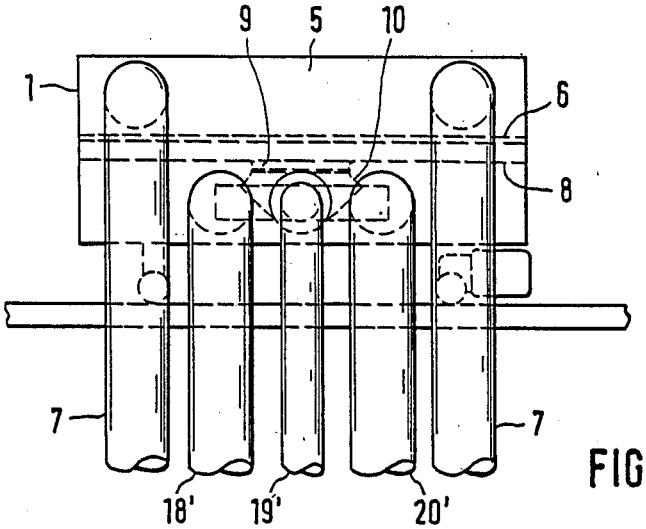
FIG. 4 are corresponding views in a fourth operating position.
Figure 4B:
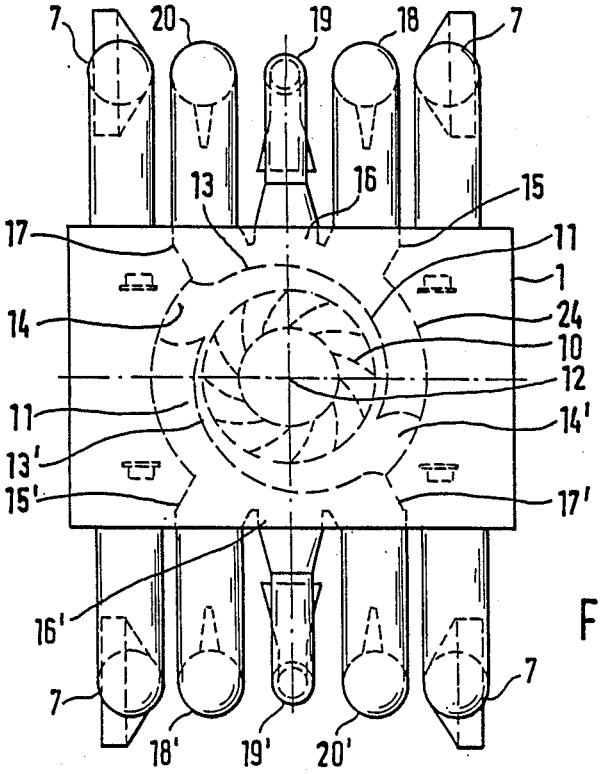

If the ventilator housing is turned into the position shown in FIG. 4, then the blast openings 14, 14' are kept sealed by the circular cylindrical wall 24. This means that the ventilator does not convey any air, thus, there is no underpressure at the sieve 6 and, as a result, the blown off fuzz which has collected in the chamber 5, can be removed from said collecting chamber 5.

It is also possible with this device to simultaneously supply four blow hoses with air blast. For example, the ventilator housing 11 can assume a rotating position in which its blast openings 14, 14' partially cover the openings 21, 22 and 21', 22', as a result of which air blast is simultaneously conducted into the blow hoses 18, 19 or 18', 19' respectively.

I claim:

1. A device, having a housing for distributing the air blast, in a cleaning device for textile machines having blow hoses fulfilling at least two different cleaning tasks, the blast air of a ventilator being conducted alternately into said blow hoses, said, ventilator having an impeller, a spiral ventilator housing surrounding the impeller, and at least one tuyere opening which opens into at least one air duct of the device housing; the device housing having an air duct for each blow hose, the ventilator housing being pivoted about the impeller axis to have its tuyere opening into each one of the air ducts alternately.

2. A device according to claim 1 in which the ventilator housing is rotatable to a further position in which its tuyere opening is sealed by a wall of the device housing.

3. A device according to claim 1 in which the openings of the air ducts are disposed on a circular cylindrical wall section of the device housing.

4. A device according to claim 2 in which the openings of the air ducts are disposed on a circular cylindrical wall section of the device housing.

5. A device according to one of claims 3 or 4 in which the wall sealing the tuyere opening is formed by the circular cylindrical wall section.

6. A device according to one of the claims 1 to 4, in which the ventilator housing is constructed as a double spiral which is point-symmetrical with respect to the impeller axis; at least four air ducts being also disposed point-symmetrically with respect to the impeller axis in the device housing, and each tuyere opening into one of the air ducts in at least two rotational positions of the ventilator housing.

7. A device according to claim 6, in which the device housing has a circular cylindrical wall in which the ventilator housing is rotatable and at which the openings of the air ducts are disposed.

8. A device according to one of the claims 1 to 4, further comprising a collecting sieve and a collecting chamber above the sieve, having suction tubes attached thereto, being disposed in the device housing in a plane above the air ducts.

9. A device according to one of the claims 1 to 4, in which the ventilator housing is constructed as a double spiral which is point-symmetrical with respect to the impeller axis, at least four air ducts being also disposed point-symmetrically with respect to the impeller axis in the device housing and each tuyere opening, opening into one of the air ducts in at least two rotational positions of the ventilator housing.

* * * * *